United States Patent [19]

Barlow

[11] 3,990,026

[45] *Nov. 2, 1976

[54] WAVEGUIDES

[75] Inventor: Harold Everard Monteagle Barlow, Epsom, England

[73] Assignee: National Research Development Corporation, London, England

[ * ] Notice: The portion of the term of this patent subsequent to Oct. 29, 1991, has been disclaimed.

[22] Filed: Aug. 12, 1974

[21] Appl. No.: 496,813

Related U.S. Application Data

[63] Continuation-in-part of Ser. No. 274,619, July 24, 1972, Pat. No. 3,845,426.

[30] Foreign Application Priority Data

| | | |
|---|---|---|
| June 28, 1974 | United Kingdom | 28836/74 |
| Aug. 2, 1971 | United Kingdom | 36203/71 |
| Dec. 20, 1971 | United Kingdom | 58951/71 |
| Oct. 17, 1973 | United Kingdom | 48474/73 |

[52] U.S. Cl. ..... 333/98 R; 333/83 R; 333/95 S; 333/96; 350/96 WG

[51] Int. Cl.[2] ..... H01P 3/12; H01P 7/06; H01P 1/16; H01P 3/20

[58] Field of Search ..... 333/95 R, 95 S, 96, 333/97 R, 98 R, 21 R; 350/96 WG

[56] References Cited

UNITED STATES PATENTS 3,845,426 10/1974 Barlow ..... 333/95 S

*Primary Examiner*—Archie R. Borchelt
*Assistant Examiner*—Marvin Nussbaum
*Attorney, Agent, or Firm*—Cushman, Darby & Cushman

[57] ABSTRACT

Hollow circular or rectangular waveguides for supporting electromagnetic waves in the dipole mode are disclosed. Special surface impedances are required for such waveguides and examples are given. The waveguides may or may not have a central member also with a special surface impedance. Means for launching the dipole mode in waveguides of this type are described.

35 Claims, 23 Drawing Figures

Fig. 2a
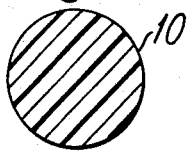
Fig. 2b
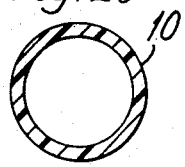
Fig. 2c
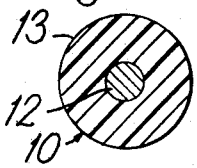
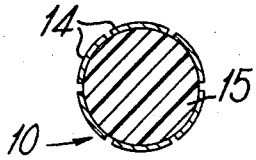
Fig. 2d
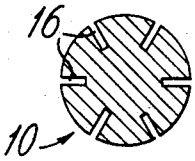
Fig. 2e
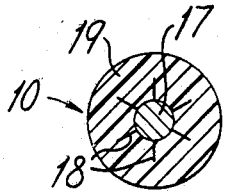
Fig. 2f
Fig. 3a
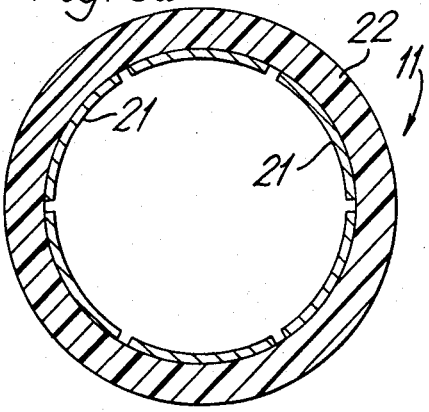
Fig. 3b
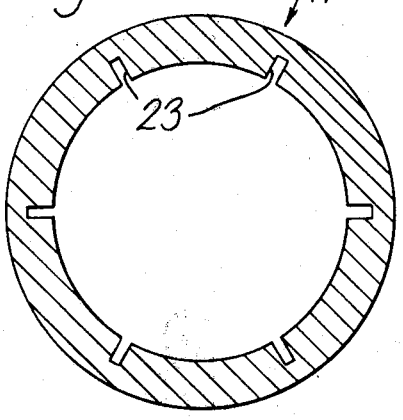
Fig. 3c
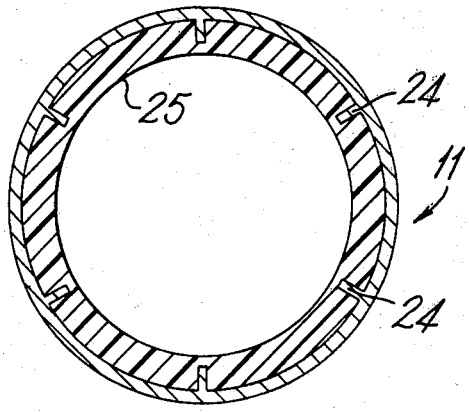

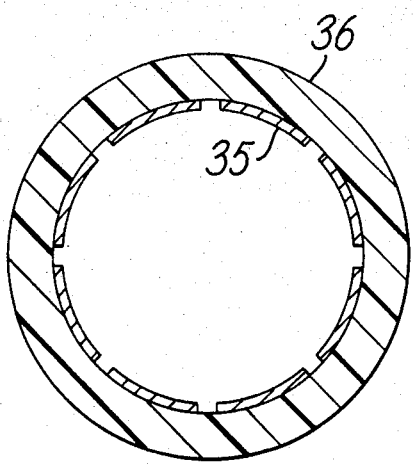
Fig 5b
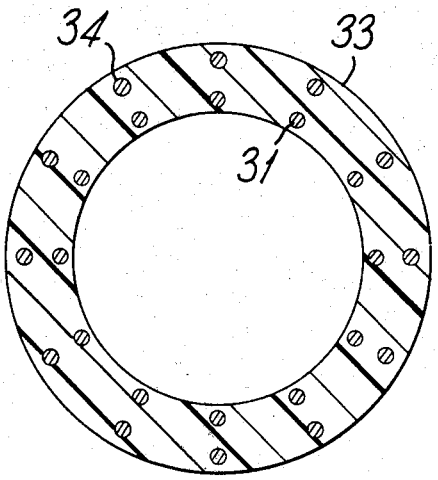
Fig 5a
Fig. 7
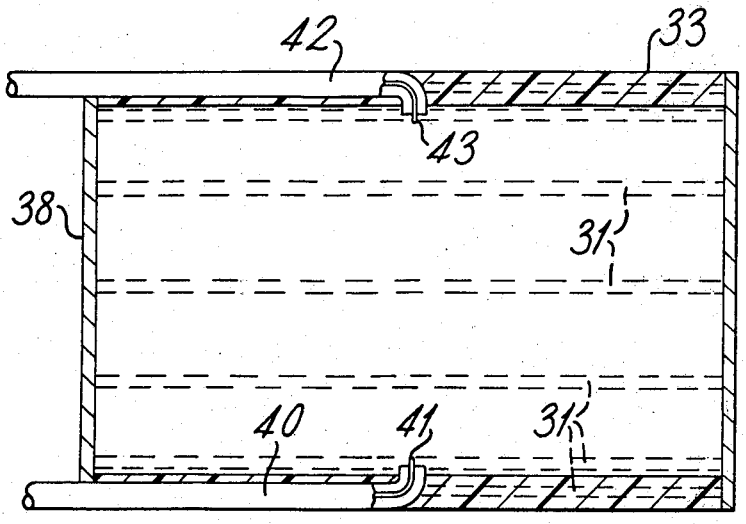

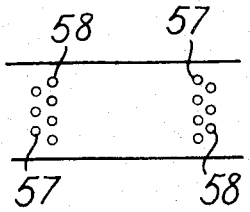
Fig. 9a
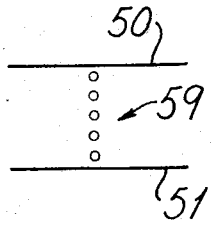
Fig. 9b
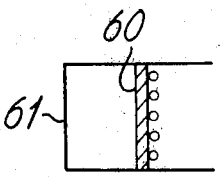
Fig. 9c
Fig. 10
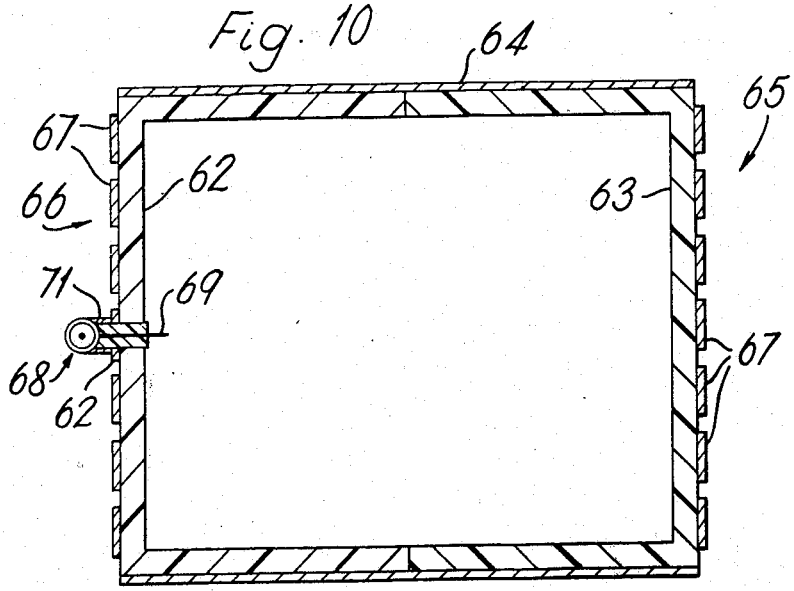

WAVEGUIDES

This application is a continuation in part from application ser. No. 274,619 filed July 24th, 1972, now U.S. Pat. No. 3,845,426.

The present invention relates to waveguides for the transmission of electromagnetic waves in a mode which has low attenuation and dispersion, and to apparatus for launching waves in this mode.

It is known that a single rod acting as a waveguide isolated in space, can support electric surface waves which, in the transverse plane, may be circularly symmetrical types designated $E_O$ and $H_O$ modes or dipole types described as $EH_n$ and $HE_n$ modes (see 'Radio Surface Waves' by Barlow and Brown, Clarenden Press, Oxford 1962). So far as the propagating medium is concerned none of these waves exhibits frequency cut-off and in principle they can all be transmitted along the outside of the guide at any part of the spectrum.

It is also known that the circularly symmetrical $E_O$ and $H_O$ modes can be screened and that the resulting co-axial structure, when comprising bare metal surfaces separated by a homogenous dielectric supporting the $E_O$ configuration, becomes none other than the usual co-axial cable carrying the so-called T.E.M. mode.

It is an object of the present invention to provide a waveguide having low attenuation in relation to conventional waveguides.

It is a further object of the invention to provide a waveguide for the dipole mode which is less susceptible to interference than the single rod mentioned above.

According to a first aspect of the present invention there is provided apparatus for supporting electromagnetic waves, including a hollow, elongated dielectric filled member having an inner surface with transverse and longitudinal impedances suitable for the propagation of electromagnetic waves in the dipole mode along the interface between the dielectric and the said inner surface and within the hollow member. In this specification the term "dielectric" includes a vacuum having a relative permittivity and relative permeability of one.

The hollow member may for example be circular or rectangular in cross-section. A second elongated member may be provided within the hollow elongated member, a first surface wave in operation, propagating along the interface between the hollow member and the dielectric, and a second surface wave in operation propagating along the interface between the second member and the dielectric, and the transverse dimensions of the hollow member and the second member and the impedances of the inner surface of the hollow member and the outer surface of the second member being so chosen that the apparatus is able to support electromagnetic waves in the dipole mode with the first and second surface waves as constituents of the waves propagated in the dipole mode.

When the second member is provided the inner surface of the hollow member and the outer surface of the second member are preferably in the cylindrical configuration, and co-axial.

Where a hollow waveguide with or without an inner field boundary surface supports the dipole mode, the waveguide may be reduced in size by the use of the "image line" technique for example in the form of a conducting surface replacing half of the waveguide.

The image line is placed in a longitudinal plane of symmetry in a position where currents compatible with the dipole mode can flow in the surface.

In this specification the term "diple mode" means any of the hybrid type $EH_{n-}$ or $HE_{n-}$ waves where the letters E and H signify that there are electric and magnetic field components in the longitudinal direction and the subscript n to one of these letters signifies the number of periods of variation of the corresponding radial or transverse field components encountered in turning through $2\rho$ radians in the transverse plane about the axis of propagation that is, the subscript n signifies the number of periods of variation of the transverse field associated with that letter either in the circumferential direction in generally circular cross-section waveguides, or, in the transverse direction normal to the surfaces for waveguides having generally parallel conducting surfaces. In the absence of further subscripts or in the presence of the subscript "-" it will be understood that this is the usual convention for signifying that the transverse field (i.e. in the radial direction or in the transverse direction parallel to the conducting surfaces) is evanescent. Where the waveguide employs a conducting surface acting as an image line, the axis of propagation, in this specification, is in the conducting surface, imaginary fields on that side of the surface remote from the real fields completing a symmetrical field. Thus the half dipole mode which occurs when an image line is used, is considered, for the purposes of this specification, as a form of the dipole mode.

In the dipole mode the transverse component of the electric field is in the same direction along the whole of one transverse axis of the appratus for $n = 1$.

The form of dipole mode discussed in this specification differs from that supported by an isolated rod in space in that the fields are due to waves supported on the inside of a hollow waveguide, originally conceived as a type of shield for the rod. Where the second member inside the hollow member is not provided, the rod may be regarded as being made infinitely small together with the wave it supports and the consequent associated field.

A further discussion of the dipole mode, waveguides and launching devices is given in U.S. application No: 274,619 (now U.S. Pat. No. 3,845,426 issued Oct. 29, 1974) from which the present specification is a continuation in part.

The present invention springs from the discovery by the inventor that the dipole mode with boundary conditions suitably modified can also propagate when the known isolated waveguide is surrounded by a co-axial screen. He has also discovered that the dipole mode will propagate along the inside of a hollow waveguide of circular or rectangular cross-section when the inner surface of the waveguide has suitable anisotropic impedances.

The advantages of screened dipole mode propagation are that with a correctly devised waveguide attenuation can be substantially less than the attenuation which occurs in more conventional waveguides and dispersion can also be considerably reduced. Further advantages which it is expected will be obtained from the present invention include effective screening of the waves propagating within the waveguide so that there is only negligible radiation from it or interference with it from an external source. A better distribution of power density within the waveguide may also be obtained, compared with conventional waveguides.

Also the mode is not subject to cut-off and in this respect compares with T.E.M. propagation.

According to a second aspect of the present invention there is provided a transmission line for supporting an electromagnetic wave, including a hollow dielectric filled cylindrical member for which the equation $$\gamma^2 n^2 = \left[ -h^2 r_2 \frac{Z_0}{Z_{x_2}} + jn\,\omega\sqrt{\mu\epsilon}\left\{1 - hr_2\left(\frac{J_{n-1}(hr_2)}{J_n(hr_2)}\right)\right\}\right]\left[-h^2 r_2 \frac{Z_{\theta_2}}{Z_0} + jn\omega\sqrt{\mu\epsilon}\left\{1 - hr_2\left(\frac{J_{n-1}(hr_2)}{J_n(hr_2)}\right)\right\}\right] \quad (1)$$

is satisfied when the apparatus supports electromagnetic waves of angular frequency $\omega$ in the dipole mode.

In this specification and claims the symbols used in the above equation, designated equation one, have the following meanings:

$\gamma$ = the longitudinal propagation coefficient;
h=ju = j(a-jb);
a = radial attenuation coefficient;
b = radial phase-change coefficient;
$r_2$ = the radius of the inner surface of the cylindrical member;
$Z_0 = \sqrt{\mu/\epsilon}$
$\epsilon$ = the permittivity of the dielectric material;
$\mu$ = the permeability of the dielectric material;
$-Z_{x2}$ = the longitudinal surface impedance of the inner surface of the cylindrical member;
$-Z_{\theta_2}$ = the transverse surface impedance of the inner surface of the cylindrical member;
for both $Z_{x2}$ and $Z_{\theta_2}$ the negative sign arises because positive impedances are defined looking towards the axis;
$J_n$ = Bessel function of the first kind and order $n$.

Equation 1 can be derived in the following way given by way of examples:-

For a travelling wave in cylindrical co-ordinates Mazwell's equations give:-

$$\left.\begin{aligned}
E_x &= A\left(H_n^{(1)}(hr) + \frac{B}{A} H_n^{(2)}(hr)\right)\\
H_x &= C\left(H_n^{(1)}(hr) + \frac{D}{C} H_n^{(2)}(hr)\right)\\
E_r &= \frac{j\gamma}{u} A\left(H_n^{(1)\prime}(hr) + \frac{B}{A} H_n^{(2)\prime}(hr)\right) + \frac{n\omega\mu}{u^2 r} C\left(H_n^{(1)}(hr) + \frac{D}{C} H_n^{(2)}(hr)\right)\\
H_r &= \frac{j\gamma}{u} C\left(H_n^{(1)\prime}(hr) + \frac{D}{C} H_n^{(2)\prime}(hr)\right) - \frac{n\omega\epsilon}{u^2 r} A\left(H_n^{(1)}(hr) + \frac{B}{A} H_n^{(2)}(hr)\right)\\
E_\theta &= \frac{\omega\mu}{u} C\left(H_n^{(1)\prime}(hr) + \frac{D}{C} H_n^{(2)\prime}(hr)\right) - \frac{j\gamma n}{u^2 r} A\left(H_n^{(1)}(hr) + \frac{B}{A} H_n^{(2)}(hr)\right)\\
H_\theta &= -\frac{\omega\epsilon}{u} A\left(H_n^{(1)\prime}(hr) + \frac{B}{A} H_n^{(2)}(hr)\right) - \frac{j\gamma n}{u^2 r} C\left(H_n^{(1)}(hr) + \frac{D}{C} H_n^{(2)}(hr)\right)
\end{aligned}\right\} \text{Equations 2}$$

where:

all the field quantities E and H are understood to contain, although not written down, the factor $(e^{-\gamma x}.\, e^{j\omega t}.e^{-jn\theta})$;
$E_x$, $E_r$ and $E_\theta$ =the electric field components in the longitudinal, radial and circumferential directions, respectively;
$H_x$, $H_r$ and $H_\theta$ = the magnetic field components in the longitudinal, radial and circumferential directions, respectively;
A and B are electric field complex amplitudes associated with the first and second members, respectively;
C and D are magnetic field complex amplitudes associated with the first and second members, respectively;

$H_n^{(1)}$ = Hankel function of the first type and order n;
$H_n^{(2)}$ = Hankel function of the second type and order n;
$h = ju = j(a-jb)$;
$\gamma^2 = h^2 - \omega^2\mu\epsilon$
$\alpha = \alpha + j\beta$;
$\alpha$ = longitudinal attentuation coefficient;
$\beta$= longitudinal phase change coefficient;

$$H_n^{(1)\prime}(z) = \frac{\partial}{\partial z} H_n^{(1)}(z) \;\&\; H_n^{(2)\prime}(z) = \frac{\partial}{\partial z} H_n^{(2)}(z);$$

From equations 2 it can be shown that $$\frac{\gamma^2 n^2}{u^4 r_1^2} = \left(\frac{1}{Z_{x1}} + \frac{\omega\epsilon}{u} F_1\right)\left(Z_{\theta 1} + \frac{\omega\mu}{u} G_1\right) \quad \text{Equation 3}$$

$$\frac{\gamma^2 n^2}{u^4 r_2^2} = \left(\frac{1}{Z_{x2}} + \frac{\omega\epsilon}{u} F_2\right)\left(Z_{\theta 2} + \frac{\omega\mu}{u} G_2\right) \quad \text{Equation 4}$$

where:

$$F_1 = -\frac{n}{hr_1} + \frac{H_{n-1}^{(1)}(hr_1) + B/A\, H_{n-1}^{(2)}(hr_1)}{H_n^{(1)}(hr_1) + B/A\, H_n^{(2)}(hr_1)}$$

and $$G_1 = -\frac{n}{hr_1} + \frac{H_{n-1}^{(1)}(hr_1) + D/C\, H_{n-1}^{(2)}(hr_1)}{H_n^{(1)}(hr_1) + D/C\, H_n^{(2)}(hr_1)}$$

with $F_2$ corresponding to $F_1$ and $G_2$ to $G_1$ when the radius is $r_2$. It is apparent therefore that two complementary surface waves occur each related to one of the supporting surfaces having radii $r_1$ or $r_2$ and, in any solution, both equations must be satisfied simultaneously.

The present inventor has discovered that equation 3 can be satisfied not only when $r_1$ has a finite value but also when $r_1 = 0$, and thus B = A and D = C, giving F1 = G1 = ∞, $$\text{Then, } F_2 = G_2 = \frac{H_{n-1}^{(2)}(hr_2)}{H_n^{(2)}(hr_2)} = \frac{J_{n-1}(hr_2)}{J_n(hr_2)},$$

at the outer surface for B = A and D = C. Equation one can be derived from equation 4.

The inventor has also found that if the inner surface of the hollow cylindrical member and the dielectric satisfies the equation $$Z_{x2}\, Z_{\theta\ 2} = Z_0^2 \quad \text{Equation 5}$$

then equation one can be simplified and numerical values more easily calculated.

Equation 5 is not a necessary condition, only a convenient one for calculation and indeed would not normally be achieved precisely in practice.

If the condition of equation 5 is utilised the impedance of the inner surface of the cylindrical member in the longitudinal direction can be either resistive and inductive when the transverse impedance is resistive and capacitive; or on the other hand when the longitudinal surface impedance is resistive and capacitive the transverse surface impedance must be resistive and inductive.

Thus according to a third aspect of the present invention there is provided a transmission line for supporting electromagnetic waves in the dipole mode, including an elongated dielectric filled cylindrical member having an inner surface with transverse and longitudinal surface impedances designated $-Z_{\ominus 2}$ and $-Z_{x2}$, respecface impedances designated $-Z_{\theta 2}$ and $-Z_{x2}$, respectively, the impedances $-Z_{\theta 2}$ and $-Z_{x2}$ substantially $$Z_{x2}\, Z_{\theta 2} = \frac{Z_0^2}{m},$$

where $Z_0$ is the characteristic wave impedance of the dielectric material, and m is a subtantially real number between one and two. The number m has a small imaginary part compared with the real part and the real part is usually a little greater than one when, as frequently desired, the wall structure has no resonant properties. With some anti-resonant structures $Z_{\theta 2}$ can be much greater than $Z_0^2/Z_{x2}$.

In this specification and claims the term "transverse surface impedance" means the impedance at the surface to current transverse to the direction of propagation of waves in the waveguide, and "longitudinal surface impedance" means the impedance at the surface to current in the direction of propagation.

Practical dielectric media for wave propagation have a relative permittivity in the range one (i.e. a vacuum) to ten and a relative permeability in the range 1 (i.e. a vacuum) to 50.

According to a fourth aspect of the present invention there is provided apparatus for supporting electromagnetic waves including first and second members having first and second conducting surfaces, respectively, which are substantially parallel to one another and separated by a dielectric filled space, and at least one structure, situated between the said surfaces, which has a longitudinal impedance, in the direction of electromagnetic waves to be supported by the apparatus, which is resistive and inductive and a transverse impedance which is resistive and capacitive, the apparatus being such that electromagnetic waves in the dipole mode propagate along the structure or structures.

The, or each, structure may comprise a plurality of conductors elongated in the direction of propagation and parallel to but separated from one another and having longitudinal axes which lie in a plane substantially orthogonal to the conducting surfaces. The, or each, structure may comprise a plurality of layers of conductors in which each layer is separated from the adjacent layer or layers, and the longitudinal axes of the conductors in each layer lie in a plane parallel to planes containing the longitudinal axes of the conductors of other layers.

A waveguide according to the fourth aspect of the invention usually comprises two of the said structures separated from one another by a distance which is often greater than the distance between the conducting surfaces.

Another waveguide according to the fourth aspect of the invention comprises only one of the said structures but in addition a third member having a conducting surface which is orthogonal to the first and second conducting surfaces, the structure and the third conducting surface being separated from one another by distance which is preferably comparable with the distance between the first and second surfaces.

In general it is desirable to provide an extension of the conducting surfaces beyond the position of the structure. This helps to reduce the spread of the field outside the structure.

Preferably the distances between the first and second surfaces, the distance between two of the said structures or between one structure and the third conducting surface are small compared with the wavelengths of waves to be propagated along the apparatus.

According to a fifth aspect of the present invention there is provided apparatus for supporting electromagnetic waves comprising an elongated dielectric filled waveguide which is rectangular in transverse cross-section, two opposite walls of the waveguide having substantially parallel conducting surfaces, one other wall having a transverse impedance $Z_y$ and a longitudinal impedance $Z_x$, and the remaining wall either having a conductive surface or transverse and longitudinal impedances $Z_y$ and $Z_x$, respectively, the distance between the said one other wall and the said remaining wall being $w$, and the structure being such that the equations $$Z_x = \left[\frac{1 - e^{-uw}}{1 + e^{-uw}}\right] \left[\frac{\pm j\sqrt{\frac{\mu}{\epsilon}}\, h^2}{-\gamma v \pm \omega\epsilon\, u\sqrt{\frac{\mu}{\epsilon}}}\right], \text{ and}$$

$$Z_y = \left[\frac{1 - e^{-uw}}{1 + e^{-uw}}\right] \left[\frac{\pm j\sqrt{\frac{\mu}{\epsilon}}\,\gamma\, v + \gamma\omega\mu u}{h^2}\right]$$

where the quantities have the meaning hereinbefore defined, are capable of being satisfied simultaneously in terms of these equations and hence the structure is capable of supporting electro-magnetic waves in the dipole mode.

In the fifth aspect of the invention the walls having parallel conducting surfaces may extend in both directions beyond the other walls.

The structure mentioned in the second aspect of the invention may take any of the forms mentioned above in relation to the first aspect of the invention.

According to a sixth aspect of the present invention there is provided apparatus for supporting and launching electromagnetic waves, including first and second members having first and second conducting surfaces, respectively, which are substantially parallel to one another and separated by a dielectric filled space, at least one structure, situated between the said surfaces, which has a longitudinal impedance, in the direction of electromagnetic waves to be supported by the apparatus, which is resistive and inductive and a transverse impedance which is resistive and capacitive, the first and second surfaces and the structure or structures being capable of supporting electromagnetic waves in the dipole mode, and means for launching waves in the dipole mode to be supported by the said surfaces and the said structure or structures.

In the sixth aspect of the invention the, or each structure may be a single elongated conductor.

Apparatus according to any above aspect of the invention may include means for launching waves in the dipole mode.

According to a seventh aspect of the present invention there is provided a method of propagating electromagnetic waves wherein the waves propagate in the dipole mode within a hollow dielectric filled elongated member along the interface between the dielectric and the inner surface of the elongated member.

According to an eighth aspect of the present invention there is provided a method of propagating electromagnetic waves in the dipole mode along one or more structures situated between parallel conducting surfaces.

The invention in its various aspect is expected to be useful in the propagation of electromagnetic waves in "optical waveguides," the wavelengths of waves propagated then being those of light rather than microwaves or lower frequency electromagnetic waves.

Certain embodiments of the invention will now be described by way of example, with reference to the accompanying drawings, in which:-

FIG. 1 shows pictorially the field pattern of the $EH_1$. dipole mode looking along a co-axial guide, FIGS. 2(*a*);, (*b*), (*c*), (*d*), (*e*) and (*f*) show various alternative forms for the inner of a co-axial waveguide for supporting the dipole mode;

FIGS. 3(*a*), (*b*) and (*c*) show various forms of the outer of a co-axial waveguide for supporting the dipole mode;

FIG. 4 shows pictorially a field pattern of the $EH_1$. dipole mode inside, and transverse to a waveguide according to the present invention;

FIGS. 5(*a*) and 5(*b*) are cross-sections of various forms of waveguides according to the present invention;

FIG. 7 shows a longitudinal cross-section of a resonant cavity according to the invention;

FIG. 8(*b*) shows the transverse electric field in the waveguide of FIG. 1(*a*);

Figure 11:
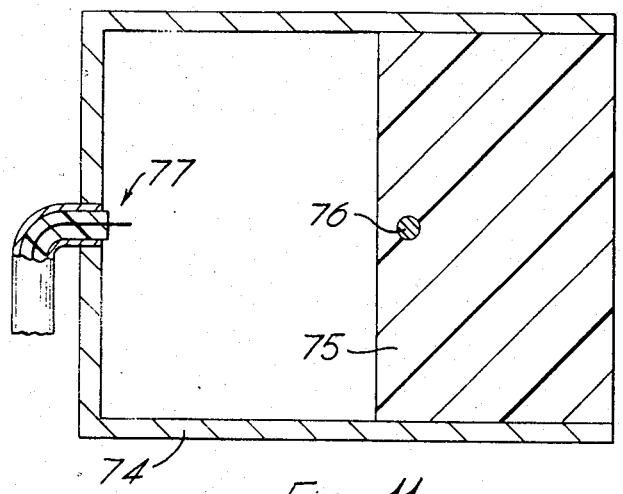
Figure 12:
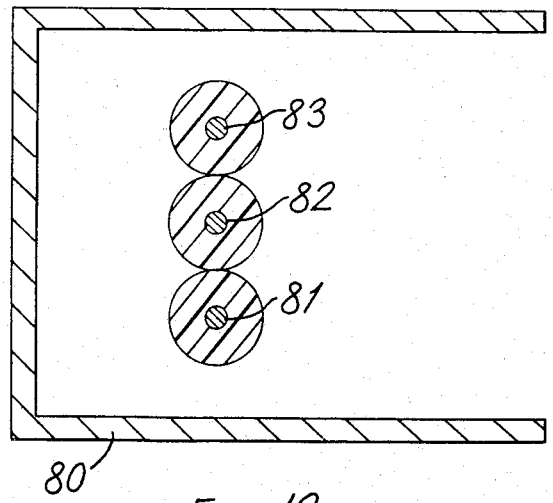

FIGS. 9(*a*) to 9(*c*) show various forms of waveguide according to the invention;

FIG. 10 shows a further rectangular waveguide according to the invention,

FIG. 11 shows a rectangular waveguide according to the invention having three walls each conductive in all directions, and FIG. 12 shows a low dispersion rectangular waveguide according to the invention.

Figure 1:
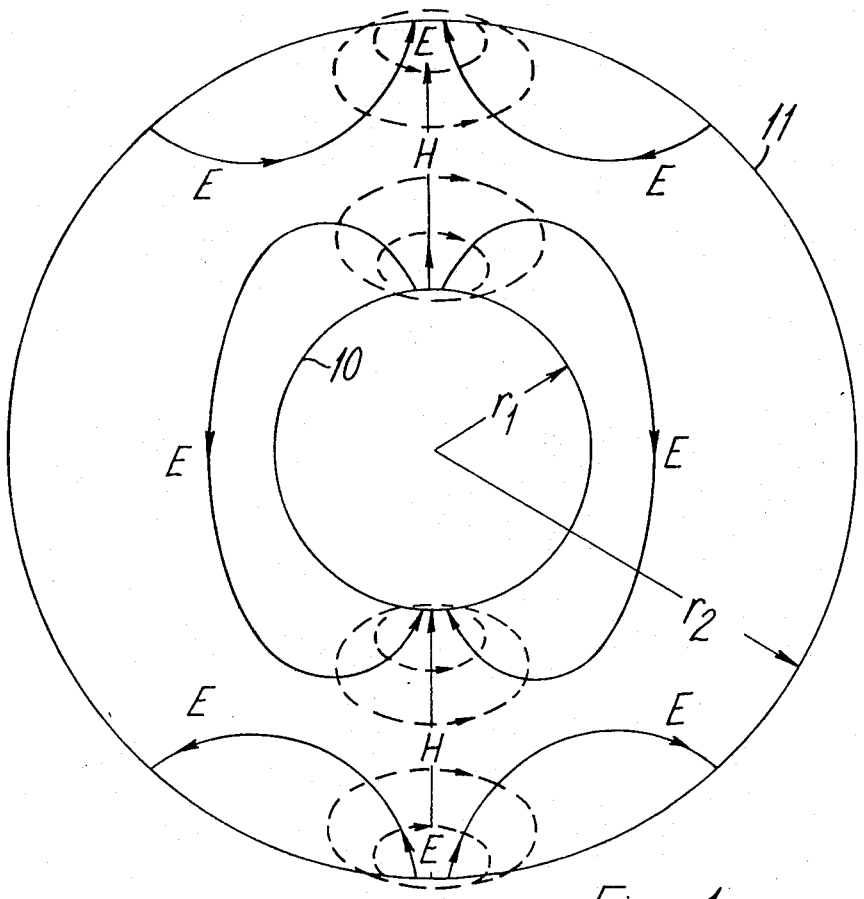

In FIG. 1 a co-axial waveguide has an inner 10 and an outer 11 (shown for convenience by means of a single line). The field pattern of the $EH_1$. dipole mode is generally as shown but may differ in the relative strengths of the field as indicated by the distance between the lines of stress. The electric field in the transverse plane is indicated by solid lines designated E and the magnetic in the transverse plane is indicated by dotted lines designated H. Since both the electric and the magnetic fields also have longitudinal components the lines fully representing the two fields would have components at right angles to the plane of the Figure.

In devising a waveguide to support the $EH_1$. or $HE_1$. dipole modes, where an inner conductor 10 is used, the equations can be simplified by satisfying the conditions of Equation 5 which leads to a condition that if the inner 10 has a resistive and inductive surface impedance in a longitudinal direction, it must have a resistive and capacitive surface impedance in the transverse direction, and the outer must have similar surface impedances. It is known (see the above mentioned book "Radio Surface Waves by Barlow H. M. and Brown J.) that a dielectric rod has the required surface impedances so that, as shown in FIG. 2(*a*), the inner 10 may be a solid dielectric rod. For example a rod made of one or more of the following plastics materials may be used: polythene, polystyrene, polyethylene, P.T.F.E. or similar plastics material. FIGS. 2(*b*) and (*c*) show other types of inner with the same kind of impedances. In FIG. 2(*b*) a dielectric tube is used and in FIG. 2(*c*) a metal rod 12 surrounded by a thick dielectric coating 13 is used. The plastics materials mentioned above may, for example, be used. Where the metal rod surrounded by dielectric is used, the following paper shows how the required impedance can be obtained:- "Theory of dielectric waveguides and some experiments at 5K.Mc/sec." by Kikuchi H. and Yamashita E., Proceedings of the Symposium on Millimeter Waves, New York 1959, pages 619–638 published by the Polytechnic Press. In general the ratio of the radii of the metal rod and the outer surface of the dielectric can have any value but preferably the ratio should not be near one for low frequencies.

Capacitance in the transverse direction can be obtained by using parallel longitudinal conductors for example copper or brass separated from one another, such as the metal strips 14 of FIG. 2(*d*). With this arrangement, in order for the capacitance to appear uniformly distributed there must be at least three metal strips 14 within one wavelength as measured circumferentially round the inner 10 at the frequency of the signal to be propagated by the guide. For convenience the metal strips may be mounted on a dielectric substrate 15 and this arrangement is particularly appropriate at low frequencies. It will be seen from Equation 1 that in principle dipole waves can be propagated in a co-axial waveguide at any frequency.

Another way of achieving capacitance in the transverse direction is to use parallel longitudinal grooves 16 in a metal rod, for example copper or brass, as shown in FIG. 2(*e*). When a wave travels down such a groove it is reflected at the end and returns to the surface. As is known, if the groove is of the correct depth, the resulting addition of the incident and reflected waves is equivalent to a capacitance at the entrance to the groove. If the groove is made very narrow compared to its depth, then the depth itself is not important in the upper range of frequencies since the field in it can be practically evanescent giving a capacitive impedance at the groove entrance. Again there must be at least three grooves per wavelength as measured circumferentially round the rod in order to give the effect of distributed capacitance.

In FIG. 2(*f*) an arrangement is shown for the inner 10 which is in some ways the inverse of the arrangement of FIG. 2(*e*). A longitudinal metal core 17 has radial fins 18 which extend parallel to one another in the longitudinal direction. The fins are embedded in a cylinder of dielectric 19 and are of such a length, and of such a number per wavelength that the surface presents a capacitive impedance in the transverse direction. Again the dielectric may be the above mentioned plastics materials. This type of structure is discussed in the above mentioned book "Radio Surface Waves" at pages 57 to 59.

With regard to the outer, longitudinal inductance and transverse capacitance can be obtained in the same ways as used in FIGS. 2(*d*), (*e*) and (*f*) for the inner. For example the outer may comprise a number of parallel longitudinal metal strips 21 (FIG. 3(*a*)) mounted on the inside of a dielectric tube 22. Again there must be sufficient strips to present what is in effect a distributed capacitance at the frequency of propagation. In another arrangement (not shown) the outer may include a number of longitudinal metal wires embedded just below the inner surface of a tube of plastics material. The outer surface of the tube may be covered with a braided screen of copper. If the operating frequency is 3GHz the wires should be copper wires of small diameter, for example 18 to 47 S.W.G. The wires are spaced about 0.3 cm. to 1 cm apart round the circumference of the inner surface but just below the surface. A suitable plastics material is polythene and the thickness of the tube wall can advantageously be approximately 1.57 cms. or a quarter of a wavelength of 3GHz. In this way penetration of the field into the tube wall is minimized. The wires can be skewed into a shallow helix provided the circumferential spacing is maintained continually. A similar structure of copper wires in a rod of plastics material may be used for the inner.

In FIG. 3(*b*) a metal cylinder with parallel longitudinal grooves 23 is used for the outer 11, the grooves being of the correct depth to present a capacitance at their entrance or arranged to support an evanescent field so that where the skin depth is small the grooves in effect form gaps in the rod's surface. As an alternative the outer 11 may be as shown in FIG. 3(*c*) where a metal cylinder has parallel longitudinal fins 24 radially arranged on its inside and the fins are embedded in a cylindrical layer of dielectric material 25. For the outer where a dielectric is used it may be of the above mentioned plastics materials, and copper or brass are suitable metals where a conductor is required in the outer.

The ratio of the radii of the outer to the inner surfaces may have any chosen value providing Equation 1 is satisfied but a convenient practical limit is 20:1.

Where the waveguide is to support optical frequencies the above mentioned dimensions which are related to wavelength must of course be related to the appropriate optical wavelengths, and the parallel conductor arrangement becomes rather like an optical grating.

Figure 4:
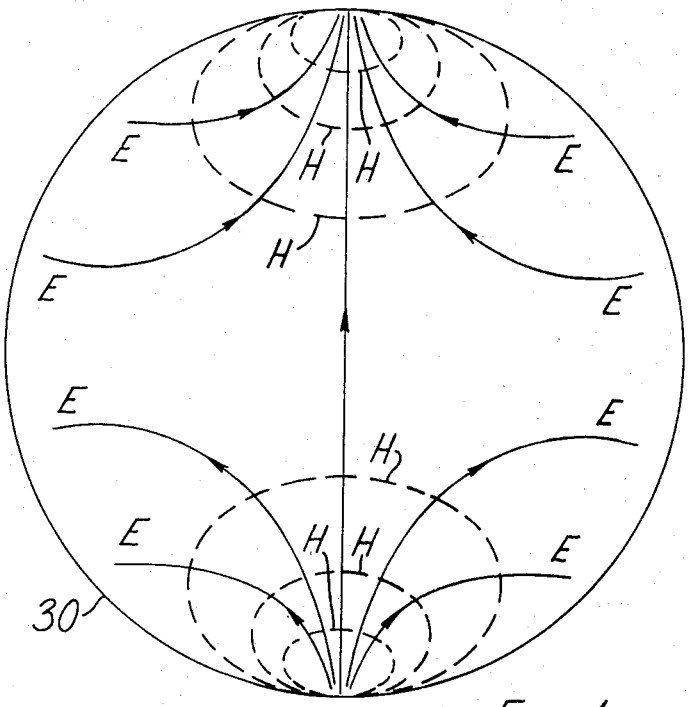

In FIG. 4 a cylindrical waveguide has an outer 30, shown for convenience by means of a single line, but no inner. The field pattern of the $EH_1$ dipole mode is generally as shown but may differ in the relative strengths of the field as indicated by the distance between the lines of stress. The electric field in the transverse plane is indicated by solid line designated E and the magnetic field in the transverse plane is indicated by dotted lines designated H. Since both the electric and magnetic fields also have longitudinal components lines fully representing the two fields would have components at right angles to the plane of the figure. It will be seen that along the vertical diameter of waveguide as shown in FIG. 4 the electric field is in the same direction across the whole diameter of the waveguide. This is in contrast to the circularly symmetrical $E_O$ and $H_O$ modes where the electric field is in opposite directions on either side of an inner conductor. Another difference between the circularly symmetrical modes and the dipole modes is that in the longitudinal direction the circularly symmetrical modes have only electric or magnetic components but the dipole modes have both electric and magnetic components.

In higher order dipole modes, that is where $n$ is greater than 1, there are $n$ regions in which the dipole field is repeated. For example, where $n = 2$, the field which occurs in one semi-circumference of FIG. 1 occurs in each quadrant.

The reasons for comparatively low attentuation and low dispersion in the dipole mode are discussed in the above mentioned specification from which this application is a continuation in part. Furthermore, the distinctions between the circularly symmetrical $E_O$ and $H_O$ modes and the dipole modes, and between the $EH_n$ and the $HE_n$ modes are also discussed in that specification.

In devising a waveguide to support the $EH_1$ or the $HE_1$ dipole modes, the problem can be simplified by satisfying approximately the condition of equation 5 which, as has been mentioned, leads to the condition that the inner surface of the cylindrical waveguide 30 may have a resistive and inductive surface impedance in a longitudinal direction but if so it must have a resistive and capacitive surface impedance in the transverse direction. The cross-section of such a waveguide is shown in FIG. 5(*a*) where a number of copper wires, such as the wire 11, are evenly spaced apart just below the periphery of a cylinder of dielectric material 33. In one waveguide which has been found to support the dipole mode at 3 G.Hz the cylinder 33 has a diameter of 3 cms and sixteen 18SWG copper wires are evenly spaced around the inner periphery. The dielectric material may be, for example, one of the following plastics materials: polythene, polystyrene, polyethylene, PTFE or similar plastics material. It is expected that there will be an optimum spacing for the wires around the inner periphery since as the spacing becomes narrower the waveguide approaches an ordinary circular waveguide with cut-off behaviour and as the spacing becomes wider the waveguide approaches a two conductor transmission line with higher losses due to non-uniform energy density distribution and radiation. For the three centimetre diameter waveguide with 18SWG wires, sixteen wires is expected to be somewhere near the optimum number, for a frequency in the neighbourhood of 3 G.Hz; but strips of copper foil are likely to prove preferable since their mutual capacitance can be smaller.

In FIG. 5(*a*) an outer ring of spaced longitudinal copper wires is also shown, one of these wires being designated 34. The outer ring of copper wires helps to provide further screening for the interior of the waveguide preventing losses by radiation. The outer ring of wires is not by any means essential to the functioning of the waveguide and the wires in the outer ring can be positioned as shown, or they may be positioned halfway between the inner wires but still at the radius shown. Instead the outer ring may include a greater or lesser number of conductors than the inner ring and strips of copper foil can take the place of the wires.

Thus the cylindrical conductors of FIG. 5(*a*) may be replaced by narrow copper strips.

This alternative type of waveguide construction according to the invention is shown in FIG. 5(*b*) where a number of longitudinal copper strips, one of which is designated 35, are spaced apart around the inner periphery of a dielectric cylinder 36. The dielectric material may be any of the plastics materials mentioned above. Again in this construction it will be seen that while the longitudinal surface impedance of such a waveguide is resistive and inductive its transverse surface impedance is resistive and capacitive.

Figure 6:
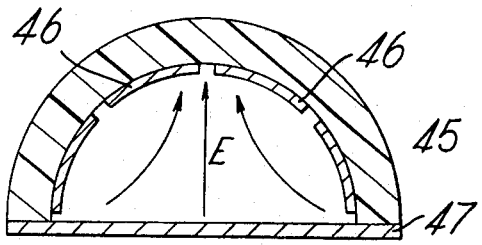
FIG. 6 is a cross-section of a further waveguide according to the invention incorporating an image line.

As has been mentioned one half of a waveguide suitable for the dipole mode can often be replaced by an image line arrangement. In FIG. 6 a semi-cylinder 45 supports a number of conducting strips 46 and is thus equivalent to half the waveguide of FIG. 5*b*. An elongated conductor 27 acts as an image line allowing currents to flow which support the dipole field shown. The image line is explained more fully below in connection with FIG. 9*c*.

FIG. 7 shows a cavity which has been shown to support the dipole mode. In cross-section it is shown in FIG. 5(*a*) without the outer ring of conductors. The longitudinal conductors are shown by means of pairs of dotted lines with, as before, only the conductor 31 designated. The cavity is cylindrical with the conductors embedded in a polythene cylinder 33. At the ends of the cavity metal plates 37 and 38 reflect waves propagated in the dipole mode. The cavity was 4.71 cms. long and 3 cms. in diameter and resonated in the dipole mode at frequencies of 3.15 to 3.18 G.Hz.

Launching of the waves is carried out at the end of a co-axial line 40, the inner 41 of which projects into the cavity. In this way an electric field component at right angles to the inner surface of the waveguide is produced as can be seen from the bottom of FIG. 4, electric field in this direction is as required for the dipole mode and the cavity becomes excited. In order to ensure that no mode dependent upon transverse resonance propagates the diameter of the cavity is made small enough to cut off such waves.

A further co-axial line 42 with detector probe 43 situated diametrically opposite the exciter probe 41 is used to sense signals in the cavity. As with the exciter the central conductor of 42 projects a little way into the cavity. As an alternative way of launching the dipole mode an electric field may be set up across the cavity between the conductor ends 41 and 43, by feeding these with input signals 180 degrees out of phase. Other ways of launching the dipole mode will be evident to those familiar with the art since what is required is to apply an electric field across a diameter, or part of a diameter of the guide. Instead of applying electric field launching loops of magnetic field may be induced round one particular surface area of the guide. It will be clear that the launching arrangements described in connection with FIG. 7 may be used equally well with a waveguide as with the cavity shown.

An example will now be given of the attenuation and phase change calculated to occur in a waveguide of circular cross-section according to the invention with a radius of 2.5 cms., a longitudinal surface impedance $Z_{x2} = -3.14 \times 10^2 (1 + j)$, a transverse surface impedance $Z_{\theta 2} = -2.26 \times 10^6 (1 - j)$ when a dipole mode at a frequency of 3G.Hz propagates in the guide. In these circumstances the attenuation is approximately $3.3 \times 10^{-3}$ Nepers per metre, and the phase change is about 62 radians per metre. It will thus be seen that the attenuation is approximately one third of that occurring in a co-axial waveguide supporting the usual circularly symmetrical wave.

Figure 8A:
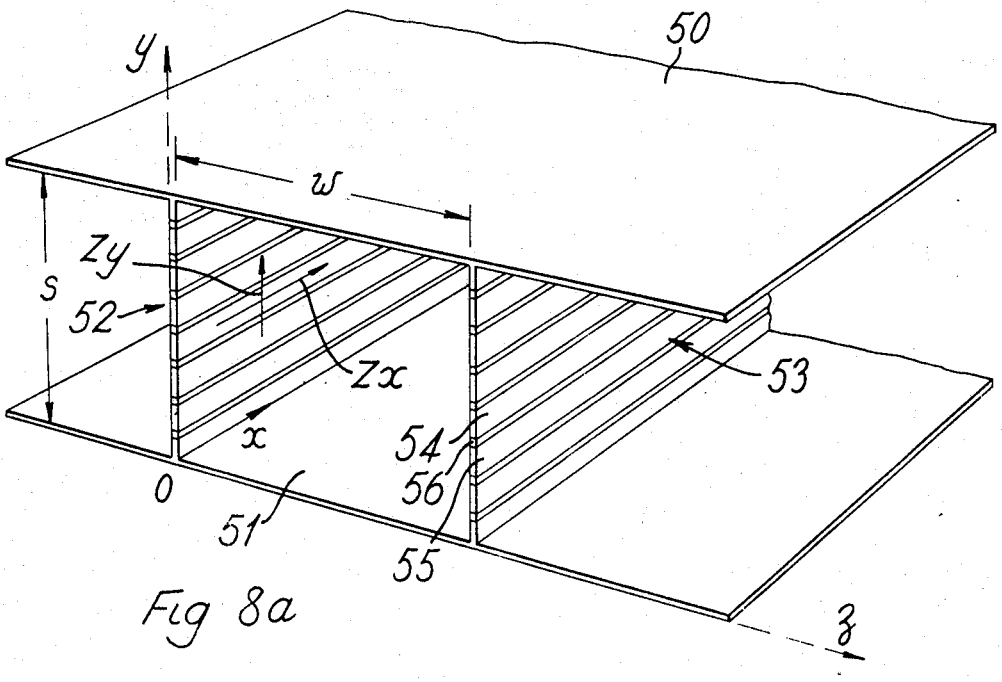
FIG. 8(*a*) shows a rectangular waveguide according to the invention.

In FIG. 8a the rectangular waveguide shown has upper and lower parallel conducting walls 50 and 51 which are shown extending beyond the rectangular cross-section portion of the guide. The extensions which are optional, serve to limit the evanescent field outside the guide and should extend at high frequency about half a wavelength at the frequency of propagation. The left and right-hand walls 52 and 53 are made up of a number of elongated conductive strips such as the strips 54 and 55 separated from one another by dielectric material and as can be seen at 56.

Axes *x*, *y* and *z* are shown superimposed on the waveguide together with a horizontal dimension *w*, the width of the guide and a vertical dimension *s*, the depth of the guide. The directions in which the impedances Zx and Zy are employed are also shown. These co-ordinates and dimensions are now used in deriving the above equations.

Figure 8B:
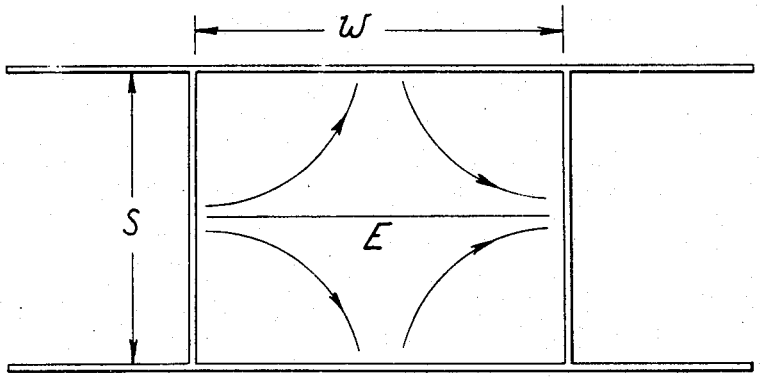

Consider the rectangular waveguide of FIG. 8(*a*) enclosing a homogeneous dielectric medium $\mu$, $\epsilon$.

The opposite walls of the guide in the (*xz*) planes are assumed to be perfectly conducting in both the *x* and *z* directions while those in the (*xy*) planes both present anisotropic impedances (looking into the inside surfaces) of values $Z_x$ and $Z_y$.

For a forward travelling wave in the +x direction with propagation coefficient $\gamma = (\alpha + j\beta)$ and corresponding axial space-dependence $e^{-\gamma x}$, transverse propagation coefficients $u = (a - jb)$ in the *z* direction and *v* in the *y* direction, each having time-dependence $e^{j\omega t}$ $$\nabla^2 E = -h^2 E$$

$$\nabla^2 H = -h^2 H$$

where $h^2 = \gamma^2 + \omega^2 \mu\epsilon = -(u^2 + v^2)$ - - - (6)

and consequently the axial field components are:-

$$E_x = A_e e^{-\gamma x} e^{j\omega t} (e^{-uz} + B_e e^{+uz})(e^{-vy} + C_e e^{+vy})$$

$$\text{and } H_x = A_m e^{-\gamma x} e^{j\omega t} (e^{-uz} + B_m e^{+uz})(e^{-vy} + C_m e^{+vy})$$

For lowest-order mode distribution along the *s* dimension of the guide, $v = +j(\pi/s)$.

Since $E_x = 0$ and $E_z = 0$ both at $y = 0$ and $y = s$ we have:-

$$C_e = -1 \text{ and } C_m = +1.$$

Moreover for a symmetrical structure with perfectly conducting surfaces in the *xz* planes $E_x = 0$ and $E_y = 0$ at $z = w/2$ giving in these circumstances:-

$$B_e e^{+uw} = -1 \text{ and } B_m e^{+uw} = +1$$

Having quoted Ex and Hx in terms of Ae, Am, Be, Bm, Ce and Cm, Hy and Ey may be written in terms of the same constants.

The surface impedances $Z_x$ and $Z_y$ in the (xy) plane at $z = 0$ and $z = w$ (looking into the surfaces from the inside) are then:-

$$Z_x = -\left(\frac{E_x}{H_y}\right)_{z=o} = +\left(\frac{E_x}{H_y}\right)_{z=w} = \left[\frac{1-e^{-uw}}{1+e^{-uw}}\right]\left[\frac{A_e/A_m\, h^2}{-\gamma v + (j\omega\epsilon u)\, A_e/A_m}\right] \quad (7)$$

$$Z_y = +\left(\frac{E_y}{H_x}\right)_{z=o} = -\left(\frac{E_y}{H_x}\right)_{z=w} = \left[\frac{1-e^{-uw}}{1+e^{-uw}}\right]\left[\frac{A_e/A_m\, \gamma v + j\omega\mu u}{h^2}\right] \quad (8)$$

Alternatively calculating surface impedances more generally at $z = 0$ and $z = w$, without introducing the condition that $E_x = 0$ and $E_y = 0$ at $z = w/2$, and subsequently equating the two $Z_x$ and $Z_y$ values we find:-

$$\frac{A_e}{A_m} = \pm j\sqrt{\frac{\mu}{\epsilon}\left(\frac{1-B_m^2\, e^{2uw}}{1-B_e^2\, e^{2uw}}\right)}$$

To make the wave impedance of the guide in the $x$ direction, namely $(E_y/H_z)$ and $-(E_z/H_y)$ almost a pure resistance i.e. $(\mu/\epsilon)$ we require:

$$\frac{A_e}{A_m} = \pm j\sqrt{\frac{\mu}{\epsilon}} \quad (9)$$

In equation (9) the negative sign is found to give, as is required in the present application, small values of $Z_x$ and correspondingly large values of $Z_y$ but using the positive sign in equation (9) the reverse is apparently possible. Both signs give resistance and inductive reactance to axial current accompanied by resistance and capacitive reactance to transverse current.

The relevant condition here is:-

$$A_e/A_m = -j\sqrt{\frac{\mu}{\epsilon}} -$$

giving the equations of the second aspect of the invention when substituted in equations 7 and 8.

From equation (6)

$$\gamma = j\sqrt{(\omega^2\mu s + a^2 - b^2 - \pi^2/S^2) - j(2ab)} = \alpha + j\beta$$

and if $\Delta = (a^2 - b^2 - \pi^2/S^2)$ $$\text{we have } \beta = \left[\sqrt{\frac{(\omega^2\mu\epsilon + \Delta)^2 + (2ab)^2 + (\omega^2\mu\epsilon + \Delta)}{2}}\right]^{1/2}$$

giving effectively a slow-wave when $\Delta$ is positive.

We also have: $\alpha\beta = ab$

All six field components are present and their distribution is found to comply substantially with dipole-type configuration.

In order to explain the operation of the waveguide of FIG. 8($a$) reference is made to FIG. 4. As is mentioned above when this circular waveguide supports the dipole mode of lowest order, the electric field is in the same direction across the whole of one diameter, for example a horizontal diameter. If now the circular waveguide becomes oblate with a flattening parallel to the electric field, the flattened parts may be replaced by conducting surfaces and one obtains a waveguide which is somewhat in the shape shown in FIG. 8($a$) and the electric field obtained is approximately as shown in FIG. 8($b$).

In FIG. 9($a$) two layers 57 and 58 of longitudinal conductors are used at each side of the waveguide instead of the single layers of FIG. 8($a$). Such an arrangement is expected to reduce the evanescent field which extends beyond the conductors.

If the distance between the vertical walls of the waveguide of FIG. 8($a$) are reduced the amplitude of the wave tends to increase. When this distance is reduced to zero the waveguide of FIG. 9($b$) is obtained, the resulting waveguide comprising the two conducting walls 50 and 51 and a single array 59 of longitudinal conductors with their longitudinal axes in a plane orthogonal to the conducting walls.

In FIG. 9($c$) one of the vertical waveguide walls 61 is made a conducting surface which forms a reflector so that the waveguide of FIG. 9($c$) is equivalent to half that of FIG. 9($a$). The conductors are supported on a dielectric strip 60, and the upper and lower walls extend beyond the plane of the conductors.

It will be observed that in FIG. 8($b$) the field is symmetrical about a vertical plane halfway along the horizontal dimension and across this plane the electric field is normal to the surface. Thus a continuous metal plate can be introduced in that plane without disturbing the field over it and a half dipole mode is preserved on each side of it. This is known as image-line technique and it can be used to develop the half dipole mode waveguide of FIG. 9($c$)when as far as equations 7, 8 and 9 are concerned the width of the guide in the $z$ direction becomes $w/2$.

Propagation of the dipole mode in a rectangular waveguide of the type shown in FIG. 9($c$) can be regarded from the following point of view: the dipole mode cannot propagate freely when confined within metal walls which prevent the field spreading in the transverse plane. However, as soon as a conductor is introduced into the field to form an obstacle extending along the length of the waveguide, the conductor interferes with the decay of the field in the transverse direction and a reflection is produced setting up a secondary evanescent field similar to the incident field. At the surface of the conductor the tangential component of the incident electric field is largely reversed. The two evanescent fields, when combined, will be seen to be, and in fact constitute, a half dipole field which accommodates itself within the limited space available. An essential feature of the metal obstacle or grid of conductors reducing the spread of the field along one transverse axis, is the anisotropic impedance it presents to the adjoining field, a characteristic requirement of the dipole mode. Some electric field necessarily extends beyond the obstacle but this is expected to be of reduced amplitude and evanescent.

A convenient form of cavity resonator for test purposes may be constructed using the cross-section of FIG. 9($c$) but with the open ends of the waveguides closed by conducting walls. Such a waveguide or cavity may be excited in the dipole mode by the use of a probe which projects at right-angles through that wall which is opposite the wall formed by the longitudinal conductors.

A form of construction for a waveguide according to the invention is shown in FIG. 10. Two channel-section P.T.F.E. members 62 and 63 are joined facing one another and metal foil is wrapped round the resulting box section. Alternatively, a metal layer can be deposited over the exterior of the box section. The foil or the metal layer is then etched or milled away along longitudinal lines at the sides 65 and 66 of the box section to give the required longitudinal conductors, some of which are designated 67. One way of launching the dipole mode is also shown in FIG. 10 where a co-axial line 68 projects through the channel section 62 and its central conductor 69 forms a probe extending into the box section. The outer conductor 71 of the line is connected to the central longitudinal conductor 72 and brought out parallel with it to one end of the guide. Thus the electric field from the probe 69 is in the correct direction for exciting the dipole mode. Similar arrangements can be used for launching the dipole mode in the other waveguides shown in FIGS. 8 and 9(*a*) and 9(*c*) and in FIG. 9(*b*) a probe fixed at the centre of the single layer of conductors may be used with the central conductor of the co-axial line pointing in one direction and another probe fixed to the outer conductor of the line pointing in the opposite direction.

A metal channel 74, preferably of copper or aluminum, is used in another waveguide according to the invention shown in FIG. 11. An elongated expanded polystyrene member 75 fills a portion of the channel and supports a single conductor 76. Dipole mode waves are launched by a probe 77 formed by a co-axial line, with its outer conductor connected to the metal channel and its centre conductor projecting into the guide. The waveguide functions in the same way as that of FIG. 9(*c*) but with only a single conductor. A plurality of conductors may alternatively be used and the conductor or conductors may be inside the expanded polystyrene, or outside, for example fixed to a smooth surface thereof. The support for the conductor or conductors may, in another arrangement, be by dielectric spacers, expanded material or otherwise. Moreover the polystyrene may fill the whole guide or may instead fill only the portion shown empty in FIG. 11.

A semi-cylindrical tube or rod of distrene or other dielectric material and of diameter typically a quarter of the waveguide width, may be mounted over the probe in FIGS. 10 or 11, adjacent to the waveguide wall, with its longitudinal axis parallel to the elongated conductors. The tube or rod usually stretches a few half wavelengths along the guide and serves to concentrate the electric field as an aid to launching.

For the cylindrical, rectangular and "single structure between conducting surfaces " wavguides the considerations of dimensions in relation to wavelength of waves to be propagated mentioned above must be applied.

An example of the calculated behaviour of a rectangular waveguide according to the invention having two walls made up of longitudinal conductors will now be given. Assuming a frequency of propagation of 3G.Hz and a waveguide with conducting walls separated by 3.4 centimetres, walls constructed from longitudinal conductors separated by 4 centimetres, a longitudinal impedance $Z_x = (1 + j)\ 3.14 \times 10^{-2}$ Ohms and a transverse impedance $Z_y = (1 - j)\ 1.88 \times 10^{6}$Ohms, it is found that the attenuation is approximately $8.2 \times 10^{-3}$ N/m and the phase change slightly greater than 62.8 radians per metre.

A certain amount of dispersion occurs in the above specifically described waveguides but where these waveguides incorporate longitudinal conductors dispersion can be reduced by surrounding the conductors individually or in a group or groups with a dielectric material having a permittivity relatively higher than the permittivity of the dielectric filling the remainder of the guide. As the frequency of the wave propagated increases the skin depth of currents in the conductors is reduced and penetration by the field into the conductor is reduced. As a result the phase velocity of the wave increases with frequency and dispersion occurs. Phase velocity, however, also depends on the energy stored in the dielectric coating over the conductors and this rises with frequency. Thus a layer of relatively higher permittivity dielectric surrounding a longitudinal conductor in a waveguide according to the invention tends to compensate for withdrawal of the field from the conductor as the frequency rises and thus reduces dispersion. The optimum thickness and permittivity of the surrounding layer is easily determined by experiment, but with an air-filled guide and a polythene coating over conductors its thickness is suitably of the same order as that of the conductor at microwave frequencies.

FIG. 12 shows an embodiment of the low dispersion waveguide according to the invention for operation in the 3G.Hz waveband. An aluminum channel 80 is 2.2 cms in depth, that is normal to the open side, and 1.03 cms in width, that is parallel to the open side. Three copper conductors 81, 82 and 83 of diameter about 0.1 cms diameter are positioned in the channel and each surrounded by a PTFE layer to give the PTFE an outer diameter of about 0.2 cms. The distance between the centres of the conductors 81 and 82, and between the centres of the conductors 82 and 83 is such that the PTFE layers are nearly in contact although this spacing is not critical. The plane in which the conductors are situated is 0.6 cms from the closed side of the channel 80. In the arrangement of FIG. 12 the PTFE has a relative permittivity of about 2.4 compared with one for the air dielectric filling the remainder of the guide.

The dielectric coating may be in other forms, for example the conductors 81, 82 and 83 may be encased in a single polythene or PTFE elongated member of cross-section equal in thickness to the PTFE layer around one conductor, and in width sufficient to encase all the conductors.

More generally the dielectric coating layer may be positioned over any surface of a waveguide according to the invention which supports a wave in the dipole mode; for example the inner surface of the outer structure of the hollow cylindrical waveguide, the outer surface of the inner member, or the innser surface of the outer, of the co-axial waveguide, or one of the inner surfaces of the rectangular waveguide carrying longitudinal current.

It will be understood that although various forms of waveguide according to the invention and various launching arrangements have been described, the invention is not limited to these specifically described examples and in fact any hollow waveguide or waveguide of the type shown in FIG. 9(*b*), which supports the dipole mode can be used in carrying out the invention as can any launching arrangement which will provide the necessary field to launch the dipole mode in such a waveguide, such as a coupling hole or slot in the wall.

What is claimed is:

1. Apparatus for supporting electromagnetic waves, including a hollow, elongated dielectric filled member having an inner surface with transverse and longitudinal impedances suitable for the propagation of electromagnetic waves in the dipole mode along the interface between the dielectric and the said inner surface and substantially within the hollow member.

2. Apparatus according to claim 1 wherein the hollow member is circular in cross-section.

3. Apparatus according to claim 2 including a second elongated member within the hollow elongated member, a first surface wave in operation, propagating along the interface between the hollow member and the dielectric, and a second surface wave in operation propagating along the interface between the second member and the dielectric, and the transverse dimensions of the hollow member and the second member and the impedances of the inner surface of the hollow member and the outer surface of the second member being so chosen that the apparatus is able to support electromagnetic waves in the dipole mode with the first and second surface waves as constituents of the waves propagated in the dipole mode at optical frequencies.

4. Apparatus according to claim 2 wherein the wall of the hollow member comprises a plurality of spaced apart elongated conductors.

5. Apparatus according to claim 4 wherein a plurality of layers of the said conductors are provided.

6. A resonator including apparatus according to claim 2 and first and second transverse conductive surfaces, one for, and terminating, each end of the hollow member.

7. Apparatus according to claim 1 wherein the hollow member is rectangular in cross-section and has two parallel electrically conductive inner surfaces.

8. Apparatus according to claim 1 wherein the transverse and longitudinal impedances are suitable for the propagation of electromagnetic waves at optical frequencies in the dipole mode.

9. Apparatus according to claim 1 wherein the hollow member is semi-circular in cross-section with that inner surface which corresponds with the semi-circle diameter formed with electrically conductive material.

10. Apparatus according to claim 9 wherein the semi-circular wall of the elongated member comprises a plurality of spaced apart elongated conductors.

11. Apparatus according to claim 1 including means for launching electromagnetic waves in the dipole mode.

12. Apparatus according to claim 1 including means for reducing dispersion in waves supported by the apparatus comprising a layer of dielectric material at least partially covering the said inner surface, the dielectric material having a higher permittivity than that of the dielectric within the hollow member.

13. Apparatus according to claim 3 including means for reducing dispersion in waves supported by the apparatus comprising a layer of dielectric material at least partially covering the said outer surface of the second member the dielectric material having a higher permittivity than that of the dielectric between the second member and the hollow member.

14. Apparatus according to claim 2 including a second elongated member within the hollow elongated member, a first surface wave in operation, propagating along the interface between the hollow member and the dielectric, and a second surface wave in operation propagating along the interface between the second member and the dielectric, and the transverse dimensions of the hollow member and the second member and the impedances of the inner surface of the hollow member and the outer surface of the second member being so chosen that the apparatus is able to support electromagnetic waves in the dipole mode with the first and second surface waves as constituents of the dipole mode, the apparatus also including means for reducing dispersion in waves supported by the apparatus comprising a layer of dielectric material at least partially covering the said outer surface of the second member, the dielectric material having a higher permittivity than that of the dielectric between the second member and the hollow member.

15. A waveguide for supporting an electromagnetic wave, including a hollow dielectric filled cylindrical member for which the equation $$\gamma^2 n^2 = \left[ -h^2 r_2 \frac{Z_0}{Z_{x_2}} + jn\,\omega\sqrt{\mu\epsilon}\left\{1 - hr_2\left(\frac{J_{n-1}(hr_2)}{J_n(hr_2)}\right)\right\}\right]\left[ -h^2 r_2 \frac{Z_{\theta 2}}{Z_0} + jn\omega\sqrt{\mu\epsilon}\left\{1 - hr_2\left(\frac{J_{n-1}(hr_2)}{J_n(hr_2)}\right)\right\}\right] \quad (1)$$

is satisfied when the apparatus supports electromagnetic waves of angular frequency $\omega$ in the dipole mode, wherein $n$ signifies the number of periods of variation of the transverse field in the circumferential direction, $\gamma$ = the longitudinal propagation coefficient, $h = ju = j(a - jb)$;

a = radial attenuation coefficient;

b = radial phase-change coefficient;

$r_2$ = the radius of the inner surface of the cylindrical member;

$Z_0 = \sqrt{(\mu/\epsilon)}$ $\epsilon$ = the permittivity of the dielectric material;

$\mu$ = the permeability of the dielectric material;

$-Z_{x2}$ = the longitudinal surface impedance of the inner surface of the cylindrical member;

$-Z_{\theta 2}$ = the transverse surface impedance of the inner surface of the cylindrical member;

for both $Z_{x2}$ and $Z_{\theta 2}$ the negative sign arises because positive impedances are defined looking towards the axis; and $J_n$ = Bessel function of the first kind and order $n$.

16. A waveguide for supporting electromagnetic waves in the dipole mode, including an elongated dielectric filled cylindrical member having an inner surface with transverse and longitudinal surface impedances designated $-Z_{\theta 2}$ and $-Z_{x2}$, respectively, the impedances $-Z_{\theta 2}$ and $-Z_{x2}$ substantially fulfilling the equation $$Z_{x2} Z_{\theta 2} = \frac{Z_0^2}{m},$$

where $Z_0$ is the characteristic wave impedance of the dielectric material, and $m$ is a substantially real number between one and two.

17. Apparatus for supporting electromagnetic waves, including first and second members having first and second conducting surfaces, respectively, which are substantially parallel to one another and separated by a dielectric filled space, and at least one structure, situated between the said surfaces, which has a longitudinal impedance, in the direction of electromagnetic waves to be supported by the apparatus, which is resistive and inductive and a transverse impedance which is resistive and capacitive, the apparatus being such that electromagnetic waves in the dipole mode propagate along the structure.

18. Apparatus according to claim 17 wherein each structure comprises a plurality of conductors elongated in the direction of propagation and parallel to but separated from one another and having longitudinal axes which lie in a plane substantially orthogonal to the conducting surfaces.

19. Apparatus according to claim 17 comprising two of the said structures.

20. Apparatus according to claim 19 wherein each structure comprises a single conductor elongated in the direction of propagation.

21. Apparatus according to claim 19 wherein the conducting surfaces extend beyond each structure on the side thereof remote from the other structure.

22. Apparatus according to claim 19 including means for launching waves in the dipole mode to be supported by the structures and the conducting surfaces.

23. Apparatus according to claim 17 wherein each structure comprises a plurality of layers of conductors in which each layer is separated from the adjacent layer, and the longitudinal axes of the conductors in each layer lie in a plane parallel to planes containing the longitudinal axes of the conductors of other layers.

24. Apparatus according to claim 17 comprising only one of the said structures but in addition a third member having a conducting surface which is orthogonal to the first and second conducting surfaces.

25. Apparatus according to claim 24 wherein the structure comprises at least one conductor elongated in the direction of propagation.

26. Apparatus according to claim 24 wherein the conducting surfaces extend beyond the structure on the side thereof remote from the third member.

27. Apparatus according to claim 17 including means for launching waves in the dipole mode to be supported by the structure and the conducting surfaces.

28. Apparatus according to claim 17 wherein the apparatus is such that electromagnetic waves in the dipole mode at optical frequencies propagate.

29. Apparatus according to claim 17 including means for reducing dispersion in waves supported by the apparatus comprising a layer of dielectric material at least partially covering the said structure, the dielectric material having a higher permittivity than that of the dielectric within the said space.

30. Apparatus according to claim 25 wherein the said conductor is surrounded by a layer of dielectric material having a higher permittivity than that of the dielectric within the said space.

31. Apparatus for supporting electromagnetic waves comprising an elongated dielectric filled waveguide which is rectangular in transverse cross-section, two opposite walls of the waveguide having substantially parallel conducting surfaces, one other wall having a transverse surface impedance $Z_y$ and a longitudinal surface impedance $Z_x$, and the remaining wall either having a conductive surface at a distance $w/2$ from the said other wall or transverse and longitudinal surface impedances $Z_y$ and $Z_x$, respectively, when the distance between the said one other wall and in the said remaining wall is $w$, and the structure being such that the equations $$Z_x = \left[\frac{1-e^{-uw}}{1+e^{-uw}}\right]\left[\frac{\pm j\sqrt{\frac{\mu}{\epsilon}}h^2}{-\gamma v \pm \omega\epsilon u\sqrt{\frac{\mu}{\epsilon}}}\right], \text{ and}$$

$$Z_y = \left[\frac{1-e^{-uw}}{1+e^{-uw}}\right]\left[\frac{\pm j\sqrt{\frac{\mu}{\epsilon}}\gamma v + \gamma\omega\mu u}{h^2}\right]$$

where the quantities have the meaning hereinbefore defined, are capable of being satisfied simultaneously in terms of these equations and hence the structure is capable of supporting electromagnetic waves in the dipole mode.

32. Apparatus according to claim 31 wherein the conducting surfaces extend beyond each structure on the side thereof remote from the other structure.

33. A method of transmitting electromagnetic waves wherein the waves propagate in the dipole mode substantially within a hollow dielectric filled member along the interface between the dielectric and the inner surface of the elongated member, said method comprising:

providing a hollow elongated member, providing a dielectric filling within said hollow elongated member, and providing said member with first and second effective impedances in the longitudinal and transverse dimensions of said member, which first and second impedances are adapted to support propagation of electromagnetic waves in a dipole mode along the interface between the dielectric and the inner surface of the elongated member.

34. A method of propagating electromagnetic waves in the dipole mode, said method comprising:

providing first and second parallel spaced apart conductive surfaces, providing a structure situated between said conductive surfaces, and providing said structure with first and second effective impedances along directions respectively longitudinal and transverse to said conductive surfaces, which first and second impedances are adapted to support propagation of electromagnetic waves in the dipole mode along said parallel conducting surfaces.

35. A method of propagating electromagnetic waves in the dipole mode, said method comprising:

providing first and second parallel spaced apart conductive surfaces, providing a plurality of structures situated between said conductive surfaces, and providing said plurality of structures with first and second effective impedances along directions respectively longitudinal and transverse to said conductive surfaces, which first and second impedances are adapted to support propagation of electromagnetic waves in the dipole mode along said parallel conducting surfaces.

* * * * *